United States Patent [19]

Benin

[11] 4,232,835

[45] Nov. 11, 1980

[54] BOBBIN CHUCK

[75] Inventor: Joshua Benin, Newark, Del.

[73] Assignee: E. I. Du Pont de Nemours and Company, Wilmington, Del.

[21] Appl. No.: 56,948

[22] Filed: Jul. 12, 1979

[51] Int. Cl.[3] ..... B65H 54/54

[52] U.S. Cl. ..... 242/46.4

[58] Field of Search ..... 242/46.4, 46.2, 46.3, 242/46.5, 46.6, 72 R, 72 B, 72.1, 68, 68.2; 279/2 R, 2 A

[56] References Cited

U.S. PATENT DOCUMENTS

| | | | |
|---|---|---|---|
| 2,647,701 | 8/1953 | Cannard | 242/68 |
| 2,957,393 | 10/1960 | Kampmeier . | |
| 3,462,092 | 8/1969 | Mullins | 242/46.4 |
| 3,493,189 | 2/1970 | Seay | 242/72 R |
| 3,494,565 | 2/1970 | Mullins | 242/46.4 |
| 3,495,781 | 2/1970 | Graf et al. | 242/46.4 |
| 3,517,891 | 6/1970 | Zeis et al. | 242/46.4 |
| 3,593,934 | 7/1971 | Conrad et al. | 242/46.5 |
| 3,596,847 | 8/1971 | Peterson | 242/72 R |
| 3,645,466 | 2/1972 | Karlson | 242/72.1 |
| 3,700,249 | 10/1972 | Allam | 279/2 R |
| 3,722,808 | 3/1973 | Brown | 242/46.4 |
| 3,977,616 | 8/1976 | Owens et al. | 242/46.4 |
| 4,067,511 | 1/1978 | Hermanns | 242/72.1 |
| 4,068,806 | 1/1978 | Moser et al. | 242/46.4 |
| 4,093,137 | 6/1978 | Briar et al. | 242/46.4 |
| 4,103,833 | 8/1978 | Hasegawa et al. | 242/46.4 X |

*Primary Examiner*—Stanley N. Gilreath

[57] ABSTRACT

An improved collet type bobbin chuck which uses mating tapered surfaces to produce radial gripping of the bobbins without dependence on centrifugal force. Air pressure supplied to the chuck is used to release the bobbin and movable seals within the chuck are used for containing or releasing air as the chuck goes from a bobbin releasing to a bobbin gripping mode, respectively.

2 Claims, 5 Drawing Figures

BOBBIN CHUCK

BACKGROUND OF THE INVENTION

This invention relates to a bobbin chuck for use on a surface-driven yarn winding apparatus which operates at high speeds. More particularly, it relates to rotatable chucks with means for gripping and releasing a bobbin that are pneumatically operable in the grip-release mode.

It is well recognized in the textile trade that certain operations can be conducted more economically when the feed yarn is provided on larger packages, that is, on packages which contain a greater length of yarn. It is also obvious to those familiar with the synthetic fiber manufacturing processes that, within broad limits, the higher the yarn speed at windup the more economical is the process. However, the higher speed of windup in combination with the heavier packages leads to a problem in that the packages spin on the chuck as they are braked to a stop for doffing which over a relatively short period of time damages the chuck and the bobbins on which the yarn is wound. Since rapid braking is a necessary part of the efficient high-speed process, a chuck is required which is capable of more positively gripping the bobbin so as to prevent the damaging free-wheeling spin on braking.

SUMMARY OF THE INVENTION

A bobbin chuck for mounting replaceable bobbins on the external surface thereof comprising: a central shaft having a central bore; a tubular member mounted for rotation on said shaft and concentric therewith; a sleeve having a plurality of openings disposed in a concentric relationship about said tubular member, said sleeve being movable axially with respect to said tubular member and rotatable therewith; a plurality of camming members fixed to said tubular member and supporting said sleeve in said concentric relationship, said camming members having tapered camming surfaces; a plurality of radially and axially movable cam followers having mating surfaces engageable with the camming surfaces and extending through the openings in the sleeve for gripping bobbins on said chuck; a first resilient means located at one end of said shaft and seated against said shaft and said sleeve for urging said sleeve axially in one direction to urge the camming surfaces of said cam follower against said tapered camming surface to move said cam followers into a gripping position; a second resilient means located at the other end of the shaft against said sleeve for urging the camming member axially in a direction opposite to said one direction; and pneumatic means supplied with pressurized gas from the central bore of the shaft for releasing said first resilient means and allowing said second resilient means to urge said sleeve in said direction opposite said one direction and urge said cam followers away from said tapered camming surfaces to release said cam followers from a gripping position; said pneumatic means including a pressure actuated movable seal positioned between said shaft and said tubular member to direct pressurized gas to and from said pneumatic means.

DETAILED DESCRIPTION OF THE ILLUSTRATED EMBODIMENTS

Figure 1:
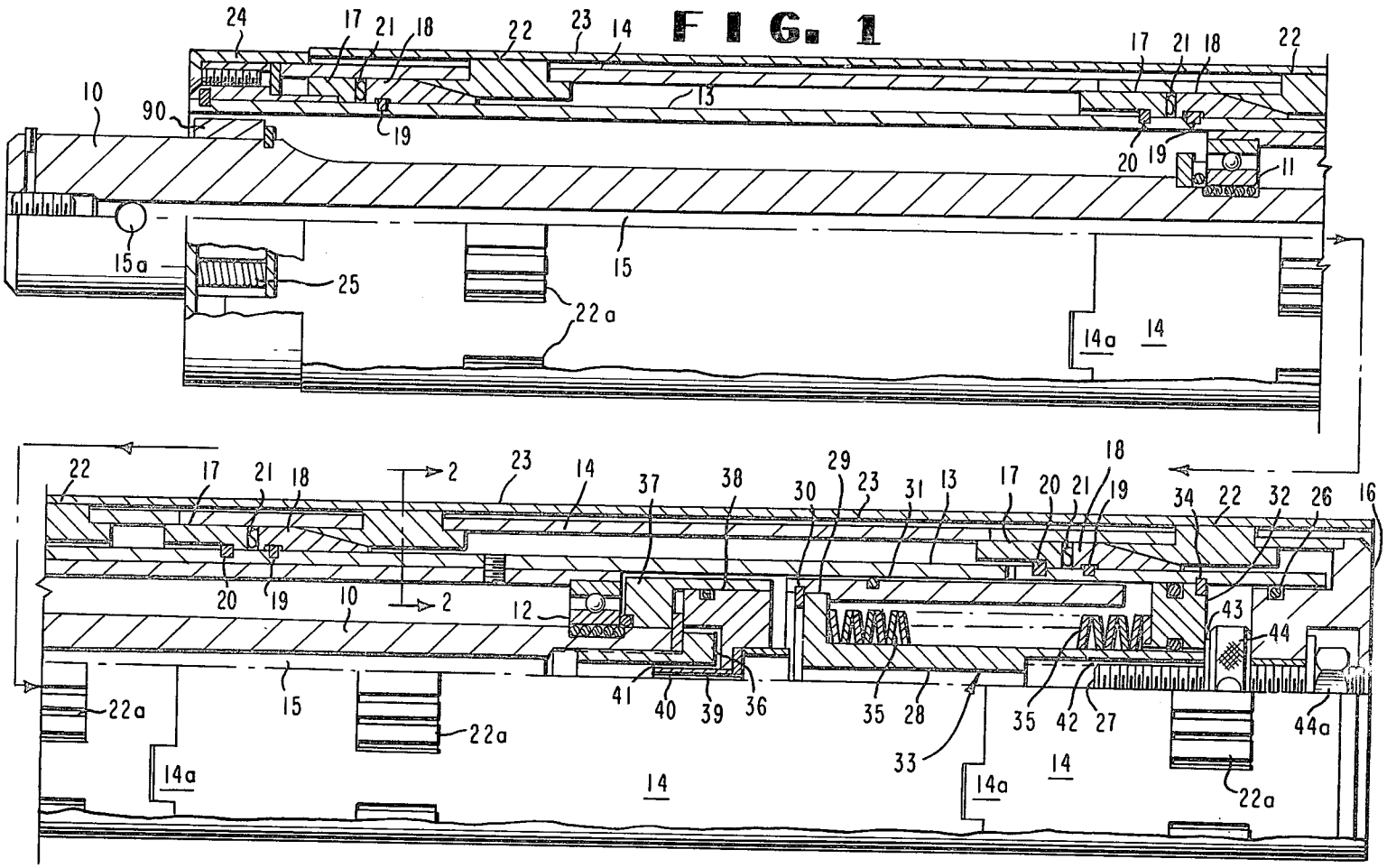
FIG. 1 is a side elevational view, partially in cross-section, of one embodiment of the chuck of this invention.

Referring to FIG. 1, the chuck generally comprises a nonrotating steel shaft 10 which is adapted to be secured to a swing arm (not shown) at its left end, ball bearings 11, 12 on the shaft which support a steel tubular member 13 which extends for substantially the entire length of the chuck, serving to support and guide bobbin gripping members and other parts to be described hereinafter and, surrounding the tubular member 13 but spaced radially outward from it, a four-piece apertured aluminum sleeve 14 which is generally coextensive with the tubular member 13. The chuck is pneumatically operated in the bobbin releasing mode and for this purpose the shaft 10 is drilled along its entire length to form passage 15 for admitting air under about 90 psig pressure via cross-passage 15*a* at the left end; at the right end of the chuck, air pressure acts on pistons 16 and 38 to effect bobbin release.

Figure 2:
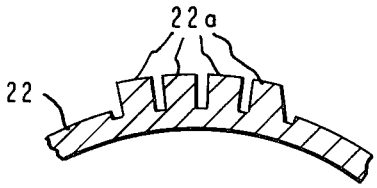
FIG. 2 is a partial transverse cross-section of a bobbin gripper taken along line 2—2 in FIG. 1.

The four piece, apertured aluminum sleeve 14 is movable axially relative to tubular member 13 by a small amount (e.g., 0.25 inch) the sleeve 14 being supported and maintained in a concentric relationship relative to member 13 by means of four Delrin ® acetal resin tubes 17 and four ramp tubes 18 that serve as camming members, the latter being of one-piece construction but split in one location (not shown) through their entire length to permit them to be pried "open" or to be flexed at assembly so as to fit over square rings 19 which are also split and which are fitted into circumferential grooves in tubular member 13; these splits also allow the ramp tubes 18 to be squeezed inwardly against tube 13 during clamping thereby eliminating all radial clearance. Similarly, three of the tubes 17 locate axially against square rings 20 in member 13. Separating each of the pairs of tubes 17 and ramp tubes 18 is a wavy washer 21 which acts as a spring tending to separate the tubes 17 and 18. On their right-hand ends, the ramp tubes 18 have a conical male taper which is matched and fitted to an identical female conical taper inside the bobbin grippers 22 which are made of Delrin ® acetal resin; each gripper 22 is made in two 165° segments to permit free radial movement in which they act as cam followers. Each 165° segment has two separate square bosses 22*a* which are slotted axially as shown in cross-section in FIG. 2; these bosses 22*a* protrude through rectangular apertures (which measure about 0.75 inch axially and 1.5 inch circumferentially) in sleeve 14 with only a slight clearance in the chuck axial direction; thus, the sleeve 14, on being moved axially, will carry the bosses and hence the grippers 22 along with it. Leftward movement will cause the conical surfaces to mate, driving the bosses outward to engage the inside of a bobbin 23 while rightward movement of the sleeve 14 will permit the grippers 22 to move radially inward and relax their grip on the bobbin.

Referring to the lower part of FIG. 1, at the interfaces between sleeves 14, each sleeve has integral tongues 14*a* interfitted with slots in the ends of the next adjacent sleeve 14 to prevent relative rotation therebetween. The entire array of sleeves 14 is locked against rotation relative to two-part brake drum 24 by means of similar tongues and grooves (not shown) at the extreme left end inside brake drum 24 which is secured to member 13. Inside brake drum 24 is a plurality of small diameter helical coil springs 25, the right hand ends of which rest against a ring at the left end of the sleeve 14, urging it (and all the others) to the right but at a relatively low level of force as discussed further below. At the right end of the chuck is plastic piston 16 which is slidably mounted inside the end of tubular member 13 being sealed by means of an O-ring 26. A stud 27, through the center of the piston is joined to it by two nuts 44 and 44*a;* the left end of the stud is threaded into a central hole of a steel pipe 28 which has a flange 29 on its left end. The outer perimeter of the flange is secured to the inside of a Delrin ® acetal resin guide tube 31 by means of a snap ring 30. The guide tube 31 is a sliding fit inside tubular member 13 so that, in effect, a unitary assembly 33 of piston 16, stud 27, pipe 28, and guide tube 31 are able to slide inside member 13. Near piston 16 is an open center wall member 32 the outer perimeter of which is secured to the inner wall of tubular member 13 by means of a snap ring 34, being sealed with an O-ring; the open center of member 32 is clear of pipe 28 and serves as its guide and is also sealed by an O-ring. The left hand face of wall member 32 serves primarily as an abutment surface for a stack of belleville washers 35 which surround the pipe 28 and form a relatively strong spring the left end of which is against the right face of flange 29. From this it will be seen that the spring 35 (compressed at assembly) being fixed at its right end (against wall 32), exerts a leftward force of about 300 lb. against flange 29 thereby causing unitary assembly 33 to be urged to the left; this has the further effect of causing piston 16 to exert a leftward force which then thrusts against the aligned sleeves 14, urging the sleeves and the bobbin grippers 22 to the left as well as radially outward as the mating cones of the grippers 22 and the ramp tubes 18 come into engagement. The total force exerted by the belleville spring 35 is greatly in excess (by a factor of about 10X) of the total spring force exerted by the coil springs 25, therefore, they are overpowered and only come into play when the spring 35 force is relieved by the application of internal pneumatic pressure to pistons 16 and 38.

In the center of the chuck, secured to the end of shaft 10 is a hollow screw 36 which secures a washer and an internally flanged brass cup 37 to the shaft; the opposite end of the cup flange rests against an O-ring and in turn against the inner race of bearing 12 securing it against a shoulder on shaft 10. Within the cup 37 is a small slidable Delrin ® acetal resin piston 38 sealed with an O-ring; the center of this floating piston is open and is provided with a tube 39 which has a large diameter to the right and has a very small diameter to the left part of which extends into the hollow screw 36 forming an annulus 41 therewith; the left end has an axial bore forming a central orifice 40 while the right end extends slightly beyond the face of the floating piston 38 so that if the piston is moved to the right by a small amount (0.05 to 0.10 inch) the end face of tube 39 will seat against the flat end of pipe 28 forming a kind of valve. The annulus 41 and the orifice 40 form flow passages for air which is admitted through passage 15 in shaft 10. The cross-sectional area of the annulus 41 is a great deal larger than the cross-sectional area of the orifice 40 (i.e., an area ratio of about 4 to 1). This is important in assuring proper sequence of operations in chuck release.

Figure 5:
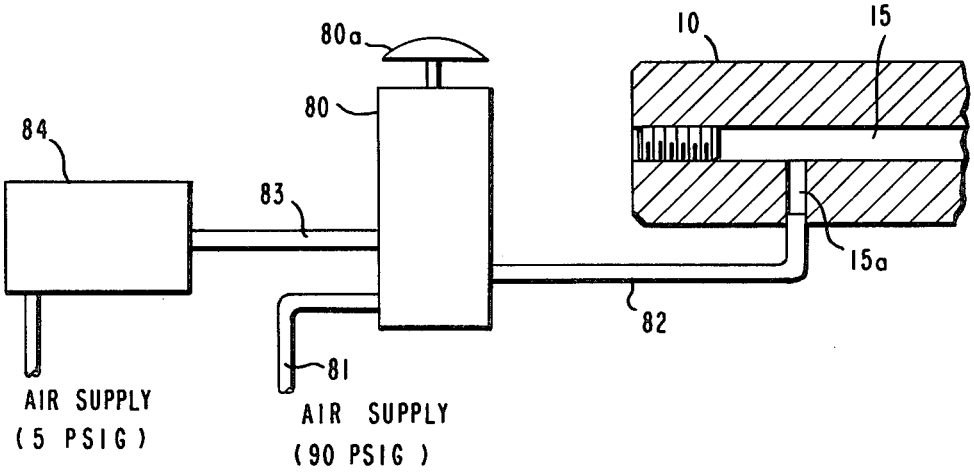
FIG. 5 is a schematic representation of an air and lubricating supply system used with the chuck of this invention.

FIG. 5 is a schematic of an air and lubricating supply system useful with the chuck described above wherein a three-way spool valve 80 with an operating button 80*a* (Model No. 250V-3-10-21, Humphrey Products Co.) is connected to a source of high pressure air (e.g., 90 psig) through conduit 81 and is connected to passage 15*a* by means of conduit 82. An oil mist lubricator 84 (e.g., Model No. 13-002-102, C. A. Norgren Company) is connected to valve 80 via conduit 83 and to a source of low pressure air (e.g., 5 psig). The valve 80 may be located at a location convenient for an operator; it may be of the manual type as described, or may be solenoid or pneumatically operated. If desired the valve 80 may be controlled in conjunction and in proper timed relationship with other winder apparatus, for example a chuck brake actuator or a doffing mechanism.

OPERATION

When release of the bobbins is desired, air is admitted to passage 15 via valve 80. Manual pressure on button 80*a* serves to admit high pressure air to passage 15; the air encounters somewhat high resistance to flow through orifice 40 as compared with annulus 41; thus, flow occurs more readily through the latter and quickly exerts pressure on the left side of floating piston 38, driving it to the right (about 0.05 to 0.10 inch) so that the large end of tube 39 seats against the end of pipe 28; this occurs before any appreciable pressure buildup occurs in pipe 28 partly because any pressurized air therein must pass small orifice 40 and also because the volume of space next to floating piston 38 is quite small and fills comparatively rapidly via annulus 41. As seating of tube 39 against pipe 28 occurs pressure buildup follows until full line pressure is exerted on the left-hand face of piston 38 and in pipe 28 as well as against the left-hand face of piston 16 (via axial slot 42 in stud 27 and radial slot 43 in nut 44) causing a combined axial force to the right sufficient to move unitary assembly 33 to the right on pistons 38 and 16 against the urging of belleville spring 35; this relieves the leftward axial loading on sleeves 14, effecting the release of the chuck which occurs as the relatively weak coil springs 25, now relieved of load, are able to shift the sleeves 14 to the right.

In reverse, when new bobbins have been placed on the chuck (air "on ") air pressure is relieved from passage 15 by releasing valve button 80*a*. Again, since annulus 41 is large, air flows from cup 37 so that the left side of piston 38 substantially reaches ambient pressure in a short time while air in pipe 28 bleeds relatively slowly through orifice 40, maintaining some pressure on the right side of piston 38 for a sufficient length of time to drive it slightly to the left, the end of tube 39 now being clear of pipe 28. This is important since, in subsequent winding operations, floating piston 38 and tube 39 are non-rotating, secured to stationary shaft 10, while pipe 28 rotates with the chuck. Thus, there is no need for a dynamic seal and no rubbing contact while the chuck is functioning in the winding mode.

When the manual pressure is removed from button 80*a* to turn the high pressure off, the conduit 83 leading from the oil mist lubricator is opened to valve 80 admitting low pressure air and lubricant to the conduit 82 and the passage 15 to lubricate the chuck bearings.

Figure 4:
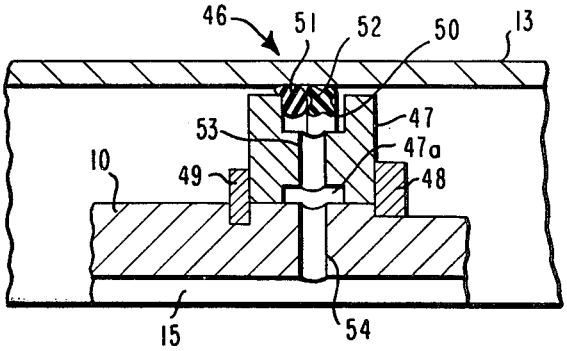
FIG. 4 is an enlarged cross-sectional view of a seal means used in the embodiment of FIG. 3.
Figure 3:
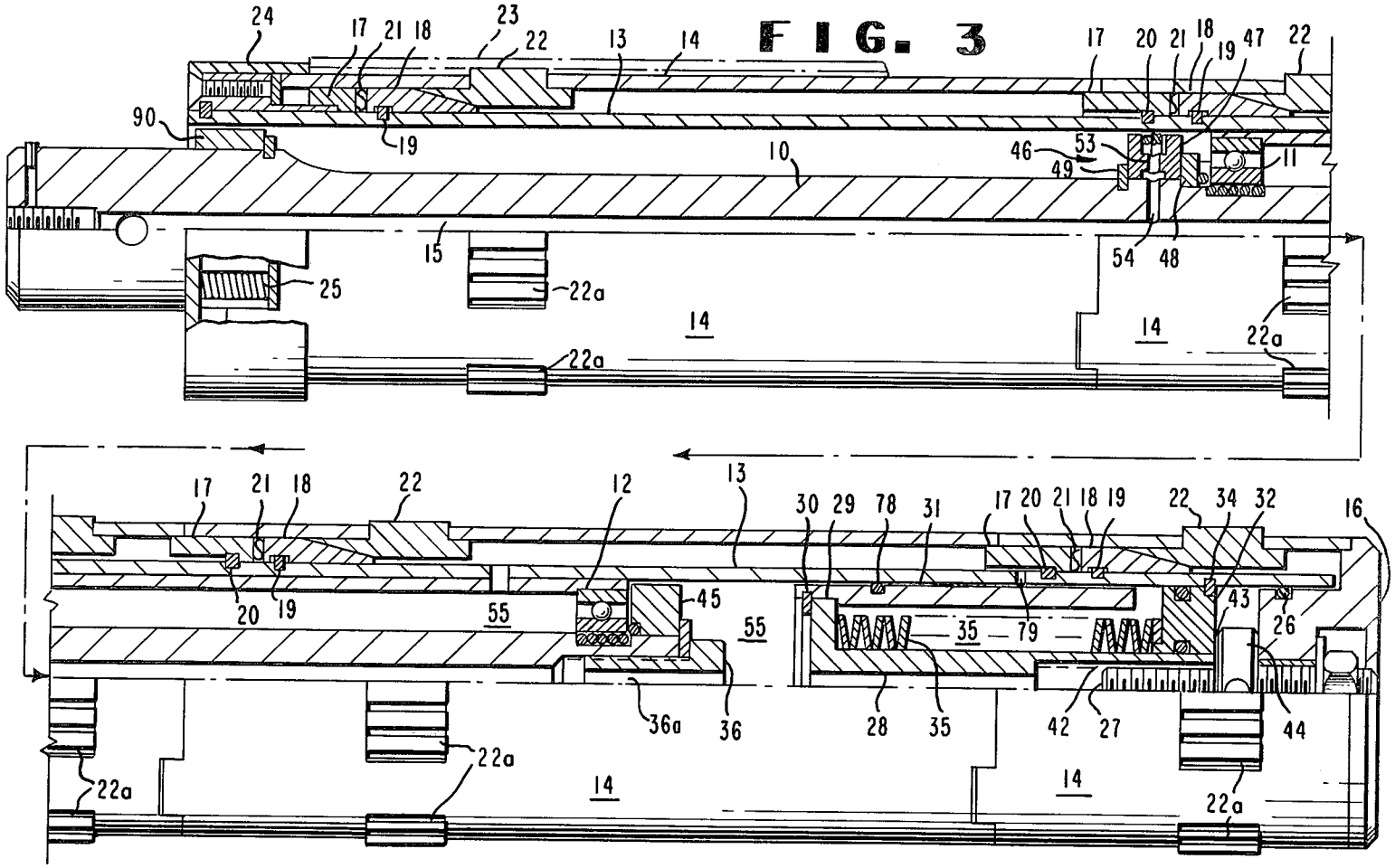
FIG. 3 is a side elevational view partially in cross-section, of a preferred embodiment of a chuck of this invention.

In a preferred embodiment, FIGS. 3 and 4, substantially all of the chuck parts are identical to those of FIG. 1 (and carry like reference characters) with the exception that the movable seal comprising the floating piston 38 and tube 39 are removed (not used) and an expanding elastomeric movable seal 46 (FIGS. 3 and 4) is added but at a different location; brass ring 45 is substituted for brass cup 37 and an O-ring 78 is installed in a groove in the outer surface of guide tube 31 to seal it relative to the inside of tubular member 13; the latter is provided with a vent hole 79 to the right of O-ring 78 so that the space generally occupied by the belleville spring 35 remains at ambient pressure. Further differences are described below.

The movable seal 46 comprises a grooved ring 47 which is fitted tightly over the shaft 10 immediately to the left of bearing 11 being located against a washer 48 and further located by a snap ring 49 in shaft 10; in the groove 50 are an O-ring 51 and a quad ring 52 which have substantially the same nominal diameter, thus are side-by-side. The durometer hardnesses of the O-ring 51 and the quad ring 52 are about 70 and 50, respectively. The relatively harder O-ring serves as back-up to avoid extrusion of the quad ring. Since the quad ring is softer it expands radially more readily than the O-ring, thus, when pressurized the quad ring is the first to expand out to the inside of member 13 thereby effecting a seal quickly. The interior of the ring 47 has an annulus 47A which opens to four radial holes 53 (one shown) in the ring 47. Similarly, the shaft 10 has four radial holes 54 which are aligned with annulus **47*a* thereby providing a fluid path from passage 15 in shaft 10 to the groove 50 (i.e., "under" the O-ring 51 and quad ring 52). At assembly, the interface between the inside of ring 47 and the outside of shaft 10** may be coated with a sealant, if desired.

In the preferred embodiment of FIGS. 3 and 4 the hollow screw 36 in the end of the shaft 10 is slightly different from other embodiments in that the central axial hole **36*a* is small so that the area ratio, taking the sum of the cross-sectional areas of all four holes 54 and dividing by the area of the single hole 36*a*, is about 5 to 1, thus, air under pressure being admitted via passage 15 will preferentially flow through holes 54 and 53 to rings 51, 52. When the pressurized air is "off" the rings 51, 52 are undistended and lie wholly within the groove 50 as shown in FIG. 3. However, when air is "on" and is admitted via passage 15 and holes 54, 53 the rings 51, 52 expand and move radially outward into engagement with the interior of tubular member 13 as shown in FIG. 4, thereby effecting a seal. Air flowing through the relatively restricted hole 36*a* and into the relatively large annular space 55 generally between shaft 10 and tubular member 13 had started to pressurize that space 55 but at a low level of pressure; with the rings 51, 52 now effecting a seal, however, the pressure in space 55 rises rapidly to line pressure whereupon the pistons 16 and 29 are acted upon in the same manner as described for the first embodiment and the release of the chuck and the bobbin is effected. When air is turned "off" and released from passage 15 by valve 80, the belleville springs 35 take over again and the chuck returns to the bobbin gripping mode. With the air "off" the O-ring 51 and the quad ring 52 contract radially into the groove in ring 47 due to their own hoop tension, reaching the position shown in FIG. 3 from which it will be seen that the rings 51, 52 will not be in rubbing contact with the inside of tubular member 13** when the latter is rotated.

Many prior art types of chucks that rely on centrifugal force for their gripping action are prone to fly apart if operated at high speed without a bobbin, e.g., when a bare chuck or a two-bobbin chuck on which only one bobbin has been installed is inadvertently brought into contact with a drive roll running at high speed. In contrast, the present chuck may be operated relatively safely without a bobbin since the radially movable elements, the grippers 22, are confined around the entire perimeter of the bosses **22*a* by the apertured sleeves 14**.

Another safety feature results from the use of plastic ring 90 (FIG. 1) on shaft 10 and brass piston 38; both are capable of slipping (rotating) on their respective supports, thus, if either or both of the bearings 11–12 fail at high speed when the chuck is carrying load, the tubular member 13 will "drop" only a very small distance due to small (e.g., 0.06 inch) radial clearance until the inside of member 13 rests on either or both of the plastic ring 90 or brass piston 38 which, due to frictional drag will start to rotate on their respective supports until the chuck and its load can be brought to a safe stop by a brake means (not shown). The diameter of piston 38 is chosen so that if the bearings 11–12 fail no part of the chuck can move off the shaft axially thus avoiding missile damage of injury to equipment or personnel. The same situation prevails in the embodiment shown in FIG. 3, except that the "emergency bearings" are plastic ring 90 and brass ring 45.

Another advantage of the present chuck is that the grippers are brought to bear on a bobbin in parallel rather than serially; i.e., when the chuck is actuated to engage a bobbin a spring means 35 acting between the sleeves 14 and the tubular member 13 exerts an axial thrust which then results in a simultaneous axial thrust on each of the paired elements comprising a gripper 22 and its ramp tube 18. The paired elements are able to adjust to local conditions and each pair is able to exert a bobbin gripping action essentially without being influenced by the state of any of the other pairs of elements. This comes about because of two features of the design, that is, the wavy washers 21 act individually as springs to determine the amount of axial force on each pair of elements of gripper 22-ramp tube 18 and, second, the axial clearance between any square ring 19 and its respective mating groove inside the ramp tube 18 permits some endwise movement of the pair of elements (relative to tubular member 13) as the gripper 22 is expanded radially to grip the bobbin. Thus, accommodation is provided for manufacturing tolerances or accumulated tolerances on chuck parts, ovality, bobbin taper, bobbin over and undersize diameters and the like.

I claim:

1. A bobbin chuck for mounting replaceable bobbins on the external surface thereof comprising: a shaft having a central bore; a tubular member mounted for rotation on said shaft and concentric therewith; a sleeve having a plurality of openings disposed in a concentric relationship about said tubular member, said sleeve being movable axially with respect to said tubular member and rotatable therewith; a plurality of camming members fixed to said tubular member and supporting said sleeve in said concentric relationship, said camming members having tapered camming surfaces; a plurality of radially and axially movable cam followers having mating surfaces engageable with the camming surfaces and extending through the openings in the sleeve for gripping bobbins on said chuck; a first resilient means located at one end of said chuck and seated against said tubular member and said sleeve for urging said sleeve axially in one direction to urge the camming surfaces of said cam follower against said tapered camming surface to move said cam followers into a gripping position; a second resilient means located at the other end of the tubular member against said sleeve for urging the camming member axially in a direction opposite to said one direction; and pneumatic means supplied with pressurized gas from the central bore of the shaft for releasing said first resilient means and allowing said second resilient means to urge said sleeve in said direction opposite said one direction and urge said cam followers away from said tapered camming surfaces to release said cam followers from a gripping position; said pneumatic means including a pressure actuated movable seal positioned between said shaft and said tubular member to direct pressurized gas to and from said pneumatic means, said pressure actuated movable seal comprising a floating piston with an orifice therethrough located between the bore in said shaft and the tubular member and movable toward and away from said pneumatic means and a tube carried by said floating piston to engage said pneumatic means.

2. The apparatus as defined in claim 1, each said camming member being in abutment with a spring and being arranged for limited axial movement relative to said tubular member, each spring being backed up by a ring fixed to said tubular member.

* * * * *